US009775385B2

(12) United States Patent
Stevenson et al.

(10) Patent No.: US 9,775,385 B2
(45) Date of Patent: Oct. 3, 2017

(54) URINATION RELIEF HATCH FOR WATERPROOF WADERS AND FOUL WEATHER GEAR

(71) Applicants: Robert A. Stevenson, Canyon Country, CA (US); Wendy L. Stevenson, Canyon Country, CA (US)

(72) Inventors: Robert A. Stevenson, Canyon Country, CA (US); Wendy L. Stevenson, Canyon Country, CA (US)

( * ) Notice: Subject to any disclaimer, the term of this patent is extended or adjusted under 35 U.S.C. 154(b) by 188 days.

(21) Appl. No.: 14/542,591

(22) Filed: Nov. 15, 2014

(65) Prior Publication Data

US 2015/0230523 A1 Aug. 20, 2015

Related U.S. Application Data

(62) Division of application No. 14/182,295, filed on Feb. 18, 2014, now Pat. No. 8,914,912.

(Continued)

(51) Int. Cl.

| | |
|---|---|
| ***A41D 1/08*** | (2006.01) |
| ***A41D 13/02*** | (2006.01) |
| ***A41D 27/00*** | (2006.01) |

(52) U.S. Cl.

CPC ..... *A41D 1/08* (2013.01); *A41D 13/02* (2013.01); *A41D 27/00* (2013.01); *A41D 2600/106* (2013.01)

(58) Field of Classification Search

CPC ..... A41D 1/08; A41D 1/088; A41D 13/012; A41D 1/06; A41D 1/065; A41D 7/00; A41D 7/005; A41D 13/02; A41D 2600/106; A41D 2600/108; A41D 1/00; A41D 1/067; A41D 27/00; A41D 27/06; A41D 27/08; A41D 27/12; A41D 2300/30; A41D 3/00; A41D 3/06; A41D 13/0015; A61F 5/449; A61F 5/448; A61F 2005/4483; A61F 2005/4486; A41H 3/00; A41H 11/00; A41H 25/00; A41H 27/00; A41H 43/04; A41H 43/00; B65D 69/00

USPC ..... 2/82, 2.15, 2.17, 456, 457, 79, 2.11, 46, 2/78.2, 87, 403–405, 408, 69, 227, 234, 2/901, 228, 238, 239, 242, 1, 243.1; 206/223, 570, 575, 581, 582

See application file for complete search history.

(56) References Cited

U.S. PATENT DOCUMENTS 291,854 A 1/1884 Platt
507,466 A * 10/1893 Van Oostrum ..... A41D 13/012 2/82

(Continued)

*Primary Examiner* — Amy Vanatta
(74) *Attorney, Agent, or Firm* — Hackler Daghighian Martino & Novak

(57) ABSTRACT

An improved fishing or hunting wader, exposure suit or foul weather pants/bib incorporates a novel waterproof connectable hatch to provide access for urination. The low profile and lightweight waterproof hatch is centered over the groin area and allows the wearer of a fishing wader, or similar foul weather gear pants, to be able to quickly open the hatch and urinate without removing the cumbersome garment. A hinged or connectable lid may swing upwards and downwards and features a hook-and-loop fastener, a magnetic, or mechanical fastener so that the lid is held up in place and out of the way. After urination, the lid may conveniently snap back into place against a seal or O-ring thereby forming a water tight seal.

20 Claims, 15 Drawing Sheets

Related U.S. Application Data

(60) Provisional application No. 61/766,089, filed on Feb. 18, 2013.

(56) References Cited

U.S. PATENT DOCUMENTS 1,488,536 A 4/1924 Fry
2,385,816 A 10/1945 Krupp
2,570,019 A 10/1951 Wolk
2,746,113 A 5/1956 Williams
2,814,405 A * 11/1957 Edwards ..... B65D 45/322 215/253
2,853,758 A 9/1958 Topf
3,034,131 A 5/1962 Lent
4,274,159 A 6/1981 Schmidt
4,558,467 A * 12/1985 Barditch ..... A41D 13/0005 2/2.17
4,593,415 A 6/1986 Vykukal
4,601,085 A 7/1986 Yoshida
4,888,859 A 12/1989 Horita
4,892,527 A 1/1990 Zivny
5,159,719 A 11/1992 Aumann
5,210,879 A 5/1993 Miller
5,346,483 A * 9/1994 Thaxton, Sr. ..... A61F 5/453 600/580
5,444,898 A 8/1995 Norvell
5,865,820 A * 2/1999 Myello ..... A61F 5/445 2/312
6,105,214 A 8/2000 Press
6,223,349 B1 5/2001 Roiser
6,296,627 B1 10/2001 Edwards
6,317,893 B1 11/2001 Walton
6,363,531 B1 4/2002 Quinn
6,389,598 B1 5/2002 Westers
6,438,757 B1 8/2002 Quinn
6,920,646 B2 7/2005 Crye
7,422,578 B2 * 9/2008 Shan ..... A61F 5/448 604/332
D621,130 S 8/2010 Brown
7,770,235 B2 8/2010 Lepage
7,803,144 B1 * 9/2010 Vollrath ..... A61F 5/453 604/349
7,867,207 B2 * 1/2011 Therkelsen ..... A61F 5/448 403/202
2004/0069828 A1 * 4/2004 Turner ..... A45C 11/22 224/660
2004/0181197 A1 * 9/2004 Cline ..... A61F 5/448 604/337
2008/0078775 A1 * 4/2008 Steiger ..... B65D 51/228 220/810
2009/0255950 A1 * 10/2009 Simkins ..... A47K 10/3818 221/45
2016/0166424 A1 * 6/2016 Hanuka ..... A61F 5/4407 604/333

* cited by examiner

URINATION RELIEF HATCH FOR WATERPROOF WADERS AND FOUL WEATHER GEAR

CROSS REFERENCE TO RELATED APPLICATIONS

This divisional application claims priority to application Ser. No. 14/182,295 filed on Feb. 18, 2014, which also claimed priority to provisional patent application 61/766,089 filed on Feb. 18, 2013, the contents of which are fully incorporated herein with this reference.

DESCRIPTION

Field of the Invention

The present invention generally relates to fishing waders. More particularly, the present invention relates to a water-tight urination relief hatch for fishing waders, foul weather gear, or aquatic sports wear.

Background of the Invention

Waist and chest waders are commonly used worldwide by both fly fishermen, spin fishermen, hunters and the like. Modern waders typically have built-in feet and in many cases, these are built-in stocking feet or neoprene-type feet or boots. Similar equipment is worn by crab fishermen or other mariners in foul weather situations wherein chest-type rain pants with suspenders are used with a jacket over the top. In a fly or spin fishing application, a fishing vest is normally worn over the wader suspenders and also a foul weather jacket may be placed over top. For example, when a fisherman is in Alaska, it is not unusual for the fisherman to have on a pair of undergarments, such as jeans over a fleece, the chest waders and suspenders, a fly fishing vest, a rain proof over jacket, a wading safety belt, and another belt containing either a canister of pepper spray or a pistol for protection against bears and other wildlife.

For both fishing and foul weather gear applications, the wader or rain protection garment may be worn for many hours or even an entire day. Hunting waders are also very popular. Hunting waders come in a variety of camouflage patterns and accommodate the hunter who is wading through bogs or tundra or even lakes (for example—duck hunters). Another name for these systems is "Waders With Bibs." One is referred to any search engine of the internet where one can enter the search term "waders" and see the wide variety that is available. Fishing wader manufacturers include Cabela's®, Orvis®, Simms®, Redbull®, Hodgman® and many others. Waders can either be simple waders or rain protection suits. Pants or chest high waders can be rubber or of modern high technical fabrics that breathe, such as Gore-Tex®.

Taking the waders and all of this equipment off to urinate is a real hassle. Not only is it inconvenient, but in a driving rain storm, one can get very wet during the process. For an Alaska fly fisherman, taking off and laying down your fly fishing vest and jacket often results in it being laid along the muddy banks of a river or worse. Furthermore, taking off all of the gear could temporarily leave a fisherman or hunter without access to a firearm or bear spray if the need to defend themselves from wildlife occurred at that same moment. Even if this unfortunate situation never happens, it is still quite disconcerting to the fisherman or hunter every time they need to remove their gear and put themselves in greater harm.

Dehydration is another important issue which can happen to a fly fisherman or hunter. With the advent of modern breathable waders, it is now possible to hike for many miles wearing your waders. In July and August of 2012, the inventors of this patent application extensively fished Southeast Alaska's rivers and streams. The inventors found there is a tendency to drink very little water because it is so much of a hassle to remove all of the gear and the waders to urinate. Leg cramps and other symptoms due to dehydration became apparent on many occasions. This is simply an unhealthy situation. What is needed is to allow a fisherman or hunter wearing a wader to drink as much as they would like and still be able to relieve themselves in a quick and efficient manner.

Many have already attempted to address such issues and concerns, yet were either unsuccessful or unable to bring their inventions to market. Orvis's® U.S. Pat. No. 7,770,235 describes a typical modern fishing wader consisting of a lightweight nylon-faced laminate material utilizing tape or sonic welds to achieve a durable, lightweight and comfortable wader. The '235 patent has no provision to facilitate urination. However, a number of rubber clothing or wader patents do disclose features for urination. For example, U.S. Pat. No. 291,854 to Platt shows a strapped opening in the front of the wader with folds to prevent water entry. This is, of course, a very crude and cumbersome approach compared to the present invention.

U.S. Pat. No. 2,385,816 illustrates a waterproof sealing closure zipper, which again, is very difficult and cumbersome to use and also, is not completely waterproof during long-term immersion, for example, in a river or a lake.

U.S. Pat. No. 2,570,019 illustrates a protrusion with a drawstring to facilitate urination. This has a number of obvious disadvantages. Not only is it aesthetically unacceptable, it would also tend to be very messy.

U.S. Pat. No. 2,746,113 illustrates yet another type of waterproof zipper, which again, is not completely waterproof during long-term immersion.

U.S. Pat. No. 2,853,758 shows a method of rolling the fabric tightly and then clamping it down to attempt a waterproof seal. This also has a lacing structure over it. Of course, all of this would be very cumbersome and probably no more efficient than simply removing the garment.

U.S. Pat. No. 4,274,159 illustrates a type of tube with a roll-up and a waterproof zipper. It is aesthetically unacceptable, messy and also cumbersome.

U.S. Pat. No. 4,601,085 illustrates a water resistant slide fastener which appears very cumbersome and difficult to use in practice.

U.S. Pat. No. 4,888,859 also illustrates a water tight slide fastener which appears to be not completely waterproof during long-term immersion.

U.S. Pat. No. 5,210,879 illustrates waders equipped with an opening and closing means to allow fisherman to urinate without having to draw the garment down. However, this opening is in the form of a tubular member, which must be coiled and then closed over with Velcro® to prevent ingress of water. Again, this is aesthetically not pleasing, messy and it is also dubious whether this would truly form a water tight seal.

U.S. Pat. No. 5,444,898 illustrates another type of water resistant closure, involving a slide fastening assembly and a pair of stringer tapes integrated with waterproof fabric. In the field, this would be difficult to use and very difficult to close back up again.

U.S. Pat. No. 6,105,214 illustrates a water resistant slide fastener with gripper elements positioned along the edges. Again, this looks like it would be very difficult to use and is of dubious quality during long-term immersion.

U.S. Pat. No. 6,223,349 illustrates a closure device for a slit opening of an aquatic sports suit. This is a type of zipper closure that may or may not be waterproof during total immersion. In any event, it would be difficult to use in the field and impractical for a chest wader. Most waders come up to well above the waist area. The drawing shown in FIG. 5 of the '349 patent is really not practical. In other words, one is not going to be able to open up the zipper at the top of the garment analogous to a pair of Levis. This is because the wader typically goes up onto the chest where there may be one or more pockets for holding fly fishing boxes and the like. This is an essential problem with all of the zipper approaches in that there is really no way to open them in the traditional way at the top. This is because the garment goes a very long way above the groin area. Zipping the entire garment, from the chest all the way down to the groin then involves pockets, a safety belt and the suspenders which rapidly becomes very impractical.

U.S. Pat. No. 6,317,893 is a good illustration of a prior art wader with a safety belt 24 and suspenders 14. This particular invention does not have provision for urination, but does illustrate the difficulty of removing the wader and pulling it down. Wader safety belt 24 is essential because if the person wearing the wader were to slip in a river or a lake, the wader legs would very quickly fill with water which could immediately add a lot of weight to the system and be life-threatening. Accordingly, one or more wader belts 24 or 18 are worn to prevent such water ingress into the system. Even if the water was not life-threatening, it would certainly wet the undergarments and make the wearer very wet and miserable for the remainder of the day.

U.S. Pat. No. 6,363,531 and U.S. Pat. No. 6,438,757 illustrate types of waterproof zippers. The '757 patent shows a zipper that is designed with a flap enclosure at the top so that it would not have to be zipped all the way up the chest area. However, the next problem it ensues is one ends up with a very narrow slit, in terms of enough of an opening, to be able to conveniently urinate.

U.S. Pat. No. 6,389,598 illustrates a sealably accessible wader system. This particular invention attempts to create a wader material that forms an opening. A removably discrete and separate closure element is detachable from the wader. This creates problems in that the closure element must be placed on the ground during urination or held with one of the user's hands. This can become awkward and difficult to operate when in use. If the closure element is placed down on the ground it can become soiled and then later interfere with the watertight seal when reattached. There is no provision to attach the closure element to the wader where it does not interfere with the urination process. Furthermore, this particular invention does not disclose or teach how such a structure will be manufactured as the wader material is not a suitable material to be used to form a water tight hatch. Wader material is substantially flexible, malleable and flowing and does not hold its shape because it is not substantially rigid. The disclosure of the patent fails to enable one skilled in the art to actually practice the invention because its structures cannot be manufactured nor do the structures work in reality.

Accordingly, there is a need to provide a convenient access hatch in the wader or equivalent garment, which can be easily flipped open allowing the wearer to urinate without removing any of the other garments, belts or accessories. None of the prior art illustrates a sealed enclosure area with a hinged lid, which can be quickly opened. The present invention provides a hinged access cover which can be round, oval or of many shapes that when shut provides a high integrity waterproof seal. It is provided with a quick release snap so that it can be opened quite readily. The opening is sufficiently large to conveniently access undergarments and to be able to urinate, and the entire system does not feature tubes or tunnels, which could become messy during urination. In addition, the access cover is provided with a convenient attachment mechanism so that it can be put up out of the way during the process. It is readily closed by snapping it back into place and once again forming a waterproof seal for the wader or garment. The present invention fulfills the needs discussed above and provides other related advantages.

SUMMARY OF THE INVENTION

An exemplary embodiment of the present invention includes a waterproof pair of waders with a sealable opening for relief of bodily fluids within a pair of pants. The pair of pants comprises a first and second foot or boot portion joined respectively to a first and second leg portion. The first and second leg portions are joined to a torso portion terminating generally at or between a waist and a neck of a wearer. The pair of pants comprise a substantially waterproof material. A separately manufactured and substantially rigid base is sealed to the pair of pants disposed in a groin section of the pair of pants, wherein the base forms an aperture. A lid is pivotably attached to the base and configured to engage the aperture. A seal is disposed between the base and the lid forming a waterproof closure of the aperture when the lid is in a closed position.

Other exemplary embodiments may include the seal disposed on the base or the seal disposed on the lid. A manually releasable latch may be connected to the base and configured to retain the lid in the closed position. A compression latch may be connected to either the lid or base and configured to secure together the lid and base. The lid may comprise a grasping feature. A temporary attachment mechanism may be connected to the base or pair of pants and configured retain the lid in an open position. The temporary attachment mechanism may comprise a magnet, a hook-and-loop fastener or a second latch. The aperture may be circular, round, rectangular, or trapezoidal shaped. The seal may comprise a compressible seal. A cosmetic flap may be connected to the pair of pants covering the base and lid. The base may be comprised of a different material as compared to the substantially waterproof material of the pair of pants.

Another exemplary embodiment of the present invention includes a waterproof pants including a pair of pants comprising a first and second foot or boot portion joined respectively to a first and second leg portion. The first and second leg portions are joined to a torso portion terminating generally at or between a waist and a neck of a wearer. The pair of pants comprise a substantially waterproof material. A water-sealable opening is connected to the pair of pants disposed generally about a groin section. The water-sealable opening comprises a substantially rigid base sealed to the pair of pants forming an aperture, and a substantially rigid lid is pivotably connected to the base and configured to engage the aperture forming a waterproof seal therebetween.

Other exemplary embodiments may include a compressible seal disposed between the base and the lid. A latch mechanism may be attached between the base and the lid and configured to keep the lid in a closed position. The lid may comprise a grasping feature. A temporary attachment mechanism may be connected to the base or pair of pants and configured to retain the lid in an open position. The temporary attachment mechanism may comprise a magnet, a hook-and-loop fastener or an upper latch. A flap may be connected to the pair of pants covering the base and lid.

Another exemplary embodiment of the present invention includes a relief hatch retro-fit kit for a pair of waders or pants. A rigid base is sealable to the pair of pants and disposed in a groin section of the pair of pants. The base forms an aperture. A lid is connectable to the base and configured to engage the aperture. A cutting template is for marking on the pair of pants a cut path.

Other exemplary embodiments may include a seal disposed between the base and the lid forming a waterproof closure when the lid is in a closed position. The base may include a flange for sealing to the pair of pants. An adhesive may be used for creating a waterproof bond between the flange and the pair of pants. A backing plate may be configured to fasten to the flange securing the pair of pants therebetween and forming a waterproof seal. A plurality of fasteners may be used for fastening the backing plate to the flange with the pair of pants therebetween. A plurality of rivets and a rivet gun may be used for fastening the backing plate to the flange with the pair of pants therebetween. At least one seal may be configured for placement between either the flange or the backing plate. A cutting board may be used for placement inside the pair of pants when cutting along the cut path.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
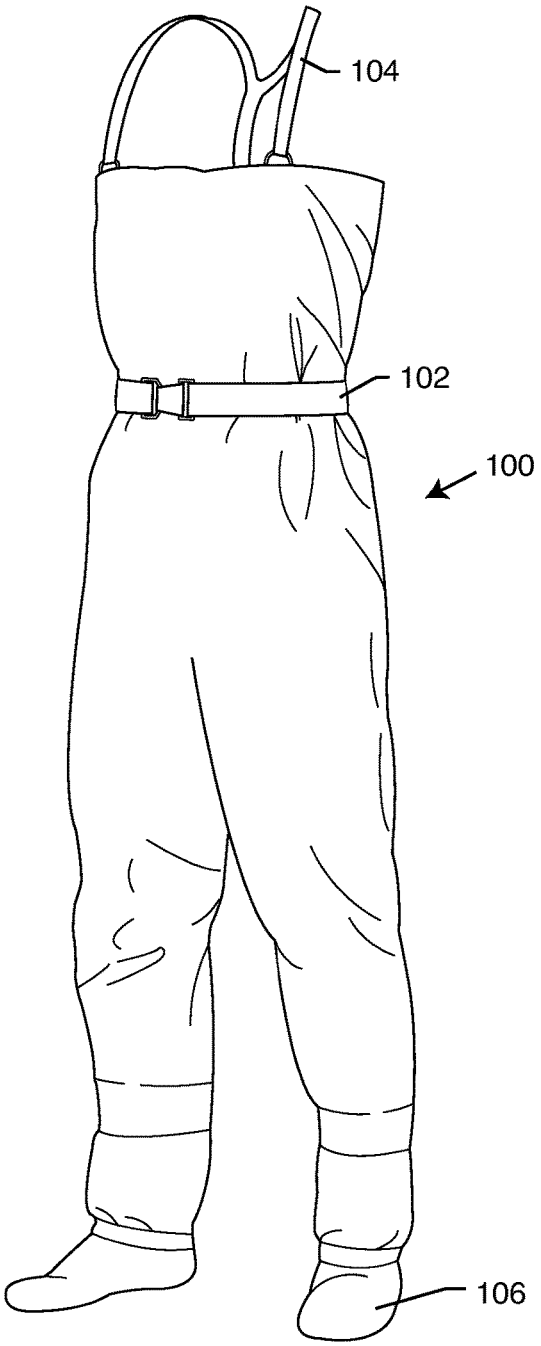
FIG. 1 PRIOR ART
FIG. 1 is a perspective view of a prior art wader.

FIG. 1 illustrates prior art chest waders 100. These are also equivalent to prior art rain gear. The chest wader 100 may be of rubber, various breathable membranes, such as Cortex® neoprene or any other fabric. In a wading application, a safety belt 102 is typically worn. This is a tightly or snugly fitting belt which prevents the rapid ingress of water into the lower part of the waders if one should, for example, slip into a deep pool in a river. The suspenders 104 are worn over the shoulders and keep the waders held up in place.

Referring once again to FIG. 1, the waders can actually include an entire family of similar garments. As defined herein, the term "wader" includes chest high waders, waste high waders, foul weather or rain suits, exposure suits, ice rescue suits, survival suits and water rescue dry suits. The term "wader" is also extendable to any type of scuba diving gear, whether they be wet or dry suits. In the broadest sense, the term "wader" as used herein refers to any type of waterproof clothing. In one embodiment, the "wader" could be rain gear where the feet 106, instead of being sealed to the wader pants, are actually a separate boot and the garment 100 is slipped down over the boots thereby keeping water from entering the boot. In a similar fashion, a rain jacket would be worn (not shown) over the wader along with a built-in hood or a hat. These types of heavy duty marine rain gear systems are worn throughout, for example, the Pacific Northwest where crab fishermen or other fishermen are on the ocean in extreme weather conditions. Ocean passage makers, such as sailors, have similar foul weather gear requirements, particularly for exposure suits.

Applications for waders with built-in feet include both traditional and fly fishermen as well as duck hunters and many other types of outdoor sports. For example, the present inventors have used waders extensively in Alaska where one not only wears the waders, but also a rain-type jacket over which (or under) is also placed a fly fishing vest. In addition, there is another belt (not shown) typically disposed somewhat below the safety belt 102, which can contain a firearm, pepper spray, a knife or similar items. The present inventors also wore hand-held radios, for example, on a belt clip.

It is very important when you are hiking and wading to stay properly hydrated. The inventors found this to be a significant problem because urination is not easy when wearing such a system as illustrated in FIG. 1 and as described. In order to urinate you first have to remove your belt containing the accessories, such as the gun, pepper spray canister and the radio. You also need to remove the fly fishing vest with all of its pockets and the rain jacket. Then you must remove the safety belt 102 and then remove the suspenders 104 at which point you are finally ready to drop down the waders to the point wear you can unzip your pants or pull down your fleece in order to perform the act of urination. When staying properly hydrated, this means, for an average adult male, that this process may be repeated from 5 to 10 times a day. Add the fact that many, if not most, fishermen are male and are in the upper age ranges (i.e. with enlarged prostates) meaning that the urination frequency becomes an enormous problem.

Figure 2:
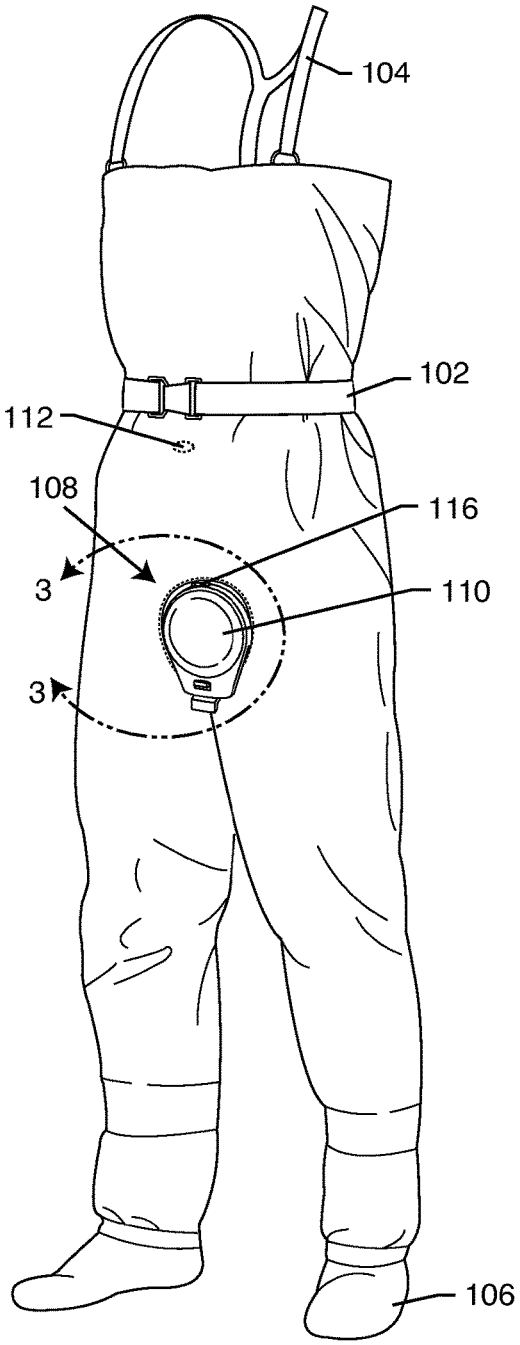
FIG. 2 is a perspective view of a wader with an exemplary relief hatch embodying the present invention.

FIG. 2 is very similar to FIG. 1, but illustrates the present invention of a urinary relief hatch assembly 108 including a lid 110 as shown. This urinary relief hatch 108 can come in many forms as will be shown in subsequent drawings. In general, it has a hermetic watertight seal and a hinge 116 so that it can be easily raised up. In this case, there is either a hook-and-loop fastener patch, a snap or the like 112 which holds the urinary relief lid conveniently up in place. The present invention is best worn with the correct undergarments, such as a fleece with a large flap instead of a zipper so one may easily access the penis. As will be shown in an alternative embodiment, it is also possible for the urinary relief flap 150 to fold downward and simply hang by gravity below the opening in the waders. It is also important that the urinary relief lid 110 be sufficiently large in diameter cross-section to easily access the undergarments. This also makes it easy for a female to use the system along with a complimentary urination device, such as the Go-Girl®. The Go-Girl® is a flexible and soft rubber-like structure that allows women to urinate while standing up. It is a hygienic, portable discrete and reusable device that can be used in concert with the present invention. It would be easy for a female to use a device, such as the Go-Girl® by opening the lid 110 of the present invention and then inserting the Go-Girl® such that it channels bodily fluid out through the open lid 110.

Figure 3:
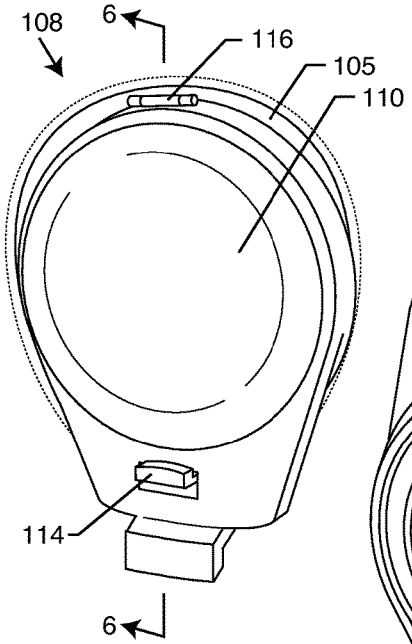
FIG. 3 is a close-up perspective view of the relief hatch in FIG. 2.

FIG. 3 is taken from section 3-3 from FIG. 2 and shows the urinary relief lid 110 in an enlarged view. Shown is a quick and convenient release snap 114 which is activated by simply pushing down with one's thumb. The lid 110 automatically flaps open as it is compressed against a rubber O-ring seal or the like attached to the base 105, which naturally acts as a spring to keep it firmly seated, but also make it open on its own. Also shown is the hinge 116 which in this embodiment, is shown on top of the urinary relief hatch.

Figure 4:
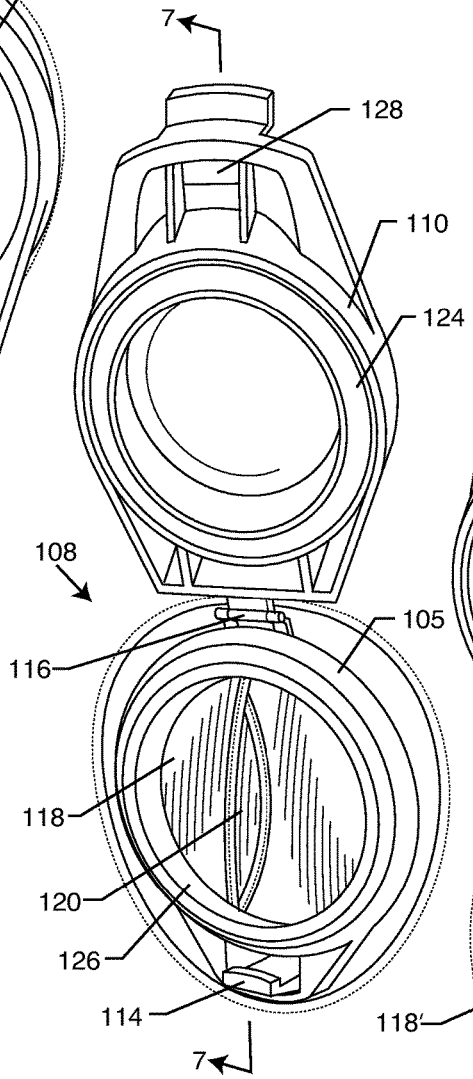
FIG. 4 is a view similar to FIG. 3 now showing the relief hatch in the open position.

FIG. 4 is the same as FIG. 3, but it shows the relief lid 110 in the open position away from the base 105. The snap 114 has been pushed down so that it disengages from the snap retainer 128 thereby allowing the entire relief lid 110 to pivot on its hinge assembly 116. A garment 118 is shown through the relief hatch. In this case, the garment is some sort of a long underwear or fleece. There is an optional flapped opening 120 for convenient access to the penis. Some types of similar garments do not have such a flap, however, during experimentation the inventors found it very easy to pull down such a garment from its elastic band and still easily access the penis. A seal of silicone rubber or similar flexible material is shown 124 which could also be an O-ring. The various types of seals are not limited by the invention, but several examples will be given in subsequent drawings. When the urinary relief lid 110 is closed, it swings down on its pivot 116 until it firmly snaps in place between the snap retainer 128 and the snap assembly itself. A variety of materials can be used for all of these structures as will be discussed in subsequent drawings such as plastics, metals, composites, wood, fiberglass, laminates or combinations thereof.

Figure 5:
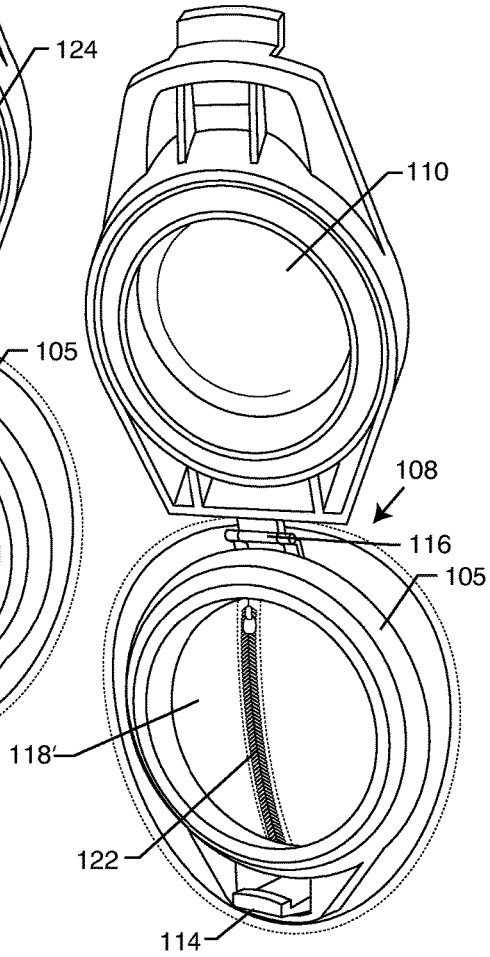
FIG. 5 is a view similar to FIG. 4 now showing a zippered pant underneath the wader.

FIG. 5 is very similar to FIG. 4 except that the undergarment 118' has a zipper 122. This would be analogous say to a simple pair of jeans. With the relief lid 110 in the open position, one can see that it would be very easy to pull down the zipper 122 to access the penis for urination. It is also noted that the present invention is intended to be used for males, but could also be used for females. Auxiliary devices may be used by females to aid in the use of the present invention. For instance, a hygienic funnel, such as the Go-Girl® may be used by females that help capture and direct urination out through the present invention.

Figure 6:
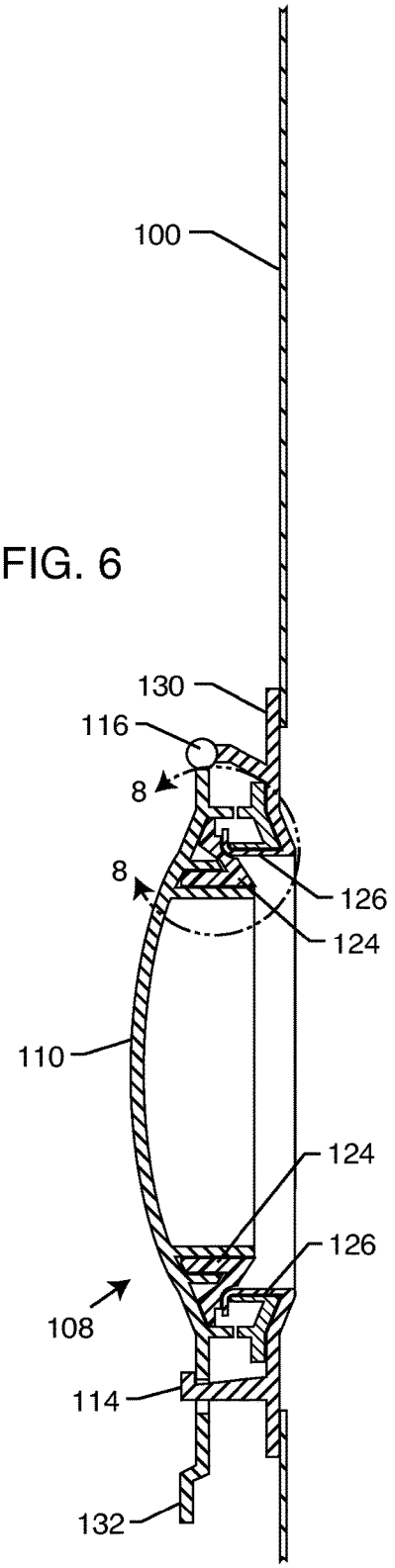
FIG. 6 is a cross-sectional view of the structure of FIG. 3 taken along line 6-6.

FIG. 6 is taken from section 6-6 from FIG. 3. The urinary relief lid 110 is shown seated closed by virtue of the snap assembly 114, 132. There is a circumferential flexible or deformable seal 124 that is shown that is seated against a seal compressor 126. One can see how the seal would be formed as it is pressed into the seal compressor 126. This forms a water-tight seal which is extremely important for waders or heavy duty rain wear. In particular, this is important when wearing waders where this area of the wader is most often times under water. A seal joint 130 is shown which makes a connection between the wader or rain gear garment 100 and the urinary relief hatch assembly 108. As will be shown, this joint can be of a thermal-setting adhesive, a glue, a rubber bond, a stitch, a thermal bond, a weld, a rivet or any other type of joint that would be waterproof and strong.

Figure 7:
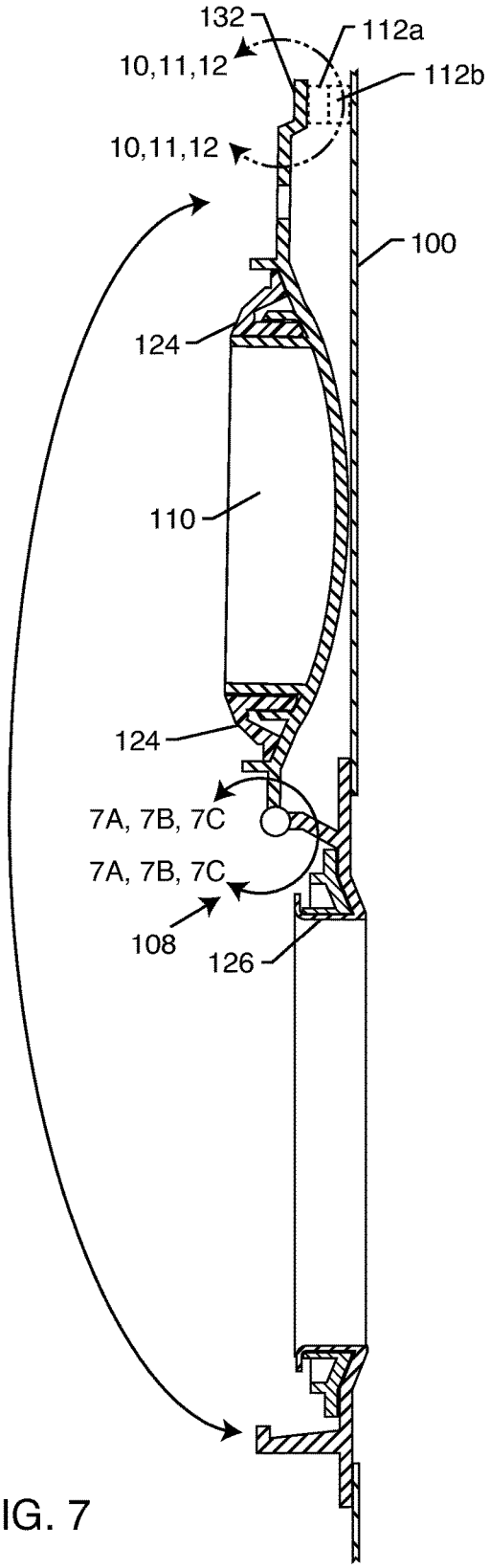
FIG. 7 is a cross-sectional view of the structure of FIG. 4 taken along line 7-7.

FIG. 7 was taken from section 7-7 from FIG. 4 and shows the urinary relief hatch assembly 108 in FIG. 6 in the open position. One can see that the water-tight deformable seal material 124 is no longer indented since it is no longer pressed against the seal compressor 126. Also, in this embodiment there is a retention assembly attached to the urinary relief handle 132. As will be shown, this relief hatch retainer 112*a* and 112*b* can be accomplished by a variety of designs. The idea of having the relief hatch in this embodiment open upwards is to provide maximum access to the penis for urinating and taking advantage of gravity so that one does not splash the lid 110 or any of its components with urine.

Figure 7A:
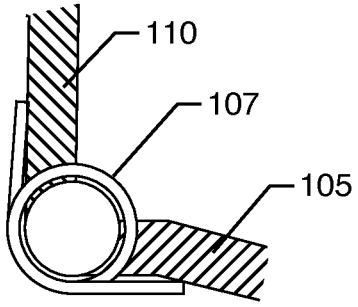
FIG. 7A is an enlarged view of similar structure of section 7A-7A taken from FIG. 7 now showing a spring mechanism.

FIG. 7A is an enlarged view of similar structure of section 7A-7A taken from FIG. 7 now showing a spring 107. The spring 107 is biasing the lid 110 to remain open and not fall down and close against the base 105. This prevents the lid 110 from unwantingly close against the base 105.

Figure 7B:
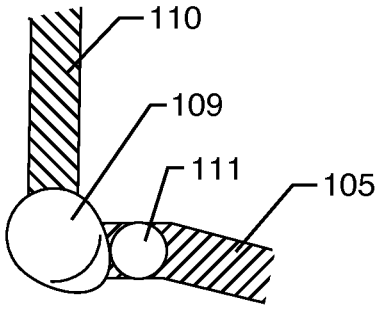
FIG. 7B is an enlarged view of similar structure of section 7B-7B taken from FIG. 7 now showing a cam mechanism in the open position.
Figure 7C:
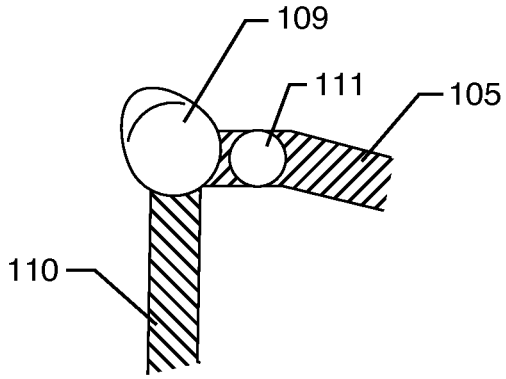
FIG. 7C is an enlarged view of similar structure of section 7C-7C taken from FIG. 7 now showing a cam mechanism in the closed position.

FIG. 7B is an enlarged view of similar structure of section 7B-7B taken from FIG. 7 now showing a cam mechanism 109, 111 in the open position. The cam 109 has a raised portion that interferes with protrusion 111. In this way when the lid 110 is open it is held in the open position. FIG. 7C is an enlarged view of similar structure of section 7C-7C taken from FIG. 7 now showing the cam mechanism 109,111 in the closed position. Here, the raised portion of the cam 109 has passed the protrusion 111 and is no longer being held open. It will be understood that the cam 109 and protrusion 111 could be placed in different locations and different positions. This example merely illustrates that a wide variety of friction joints can be used to keep the lid 110 in the open position so it does not unwantingly close against the base 105.

Figure 8:
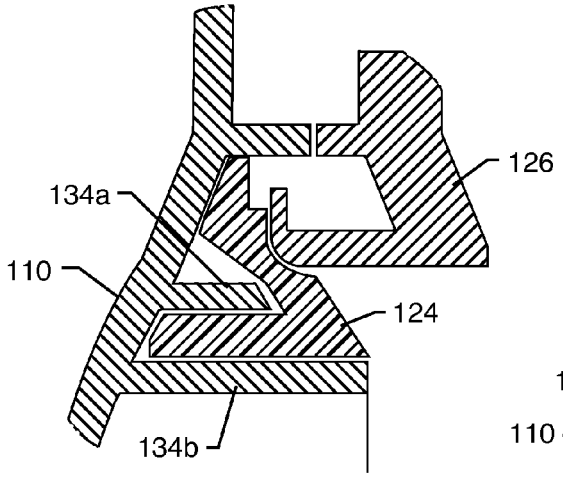
FIG. 8 is a close-up view of the structure of FIG. 6 taken along line 8-8.

FIG. 8 is an enlarged view taken from section 8-8 from FIG. 6. Shown is a portion of the urinary relief lid 110 and the flexible seal 124. The flexible seal retainer is the sandwich between structures 134*a* and 134*b*. The seal 124 is press fit in a way that is held securely or snugly while the relief lid 110 is swung up or down. Also shown is the seal compressor assembly 126. In the closed position, the deformable or compressible seal 124 is firmly seated against the seal compressor 126 in order to form a water-tight seal.

Figure 9:
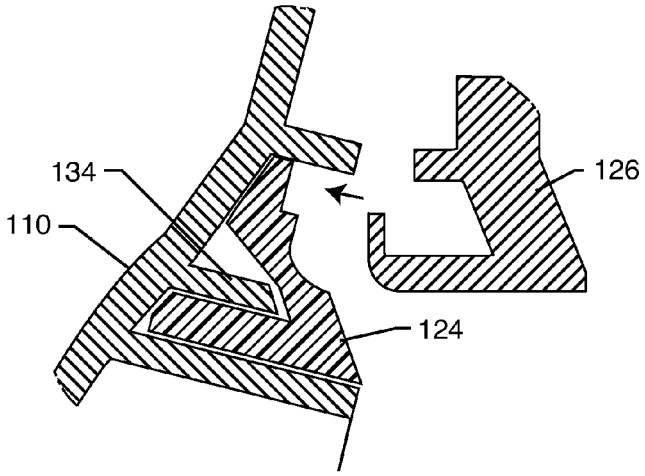
FIG. 9 is a view similar to FIG. 8, now with the lid slightly opened.

FIG. 9 is very similar to FIG. 8 and simply shows the urinary relief lid 110 in the process of being swung open. At this point, one can see that the seal material 124 is no longer indented or compressed.

Figure 10:
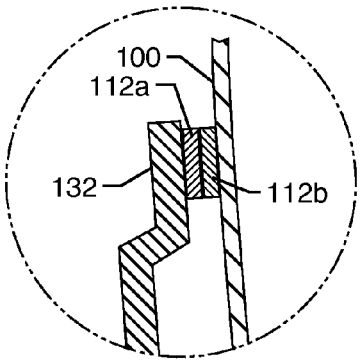
FIG. 10 is a close-up view of the structure of FIG. 7 taken along line 10-10.

FIG. 10 is taken from section 10-10 from FIG. 7. This is a retainer mechanism so that when the lid is in the upward position, it is held up while one goes about their business of urinating. In the case of FIG. 10, this would be opposite polarity magnets so that the lid is held up magnetically in place.

Figure 11:
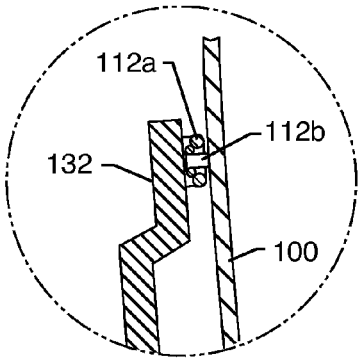
FIG. 11 is a close-up view of the structure of FIG. 7 taken along line 10-10 now showing another embodiment.

FIG. 11 is taken from section 11-11 from FIG. 7 and shows a male and female snap assembly. The female snap 112*a* is affixed to handle 132 and is pressed over the male snap portion 112*b* as shown. There is a retainer clip spring to hold the two firmly together. To unsnap this, one simply pulls against it as it pops off. The male and female portions of the snap may be used on either side.

Figure 12:
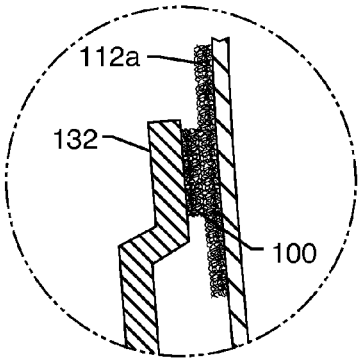
FIG. 12 is a close-up view of the structure of FIG. 7 taken along line 10-10 now showing yet another embodiment.

FIG. 12 is taken from section 12-12 from FIG. 7 and is very similar to FIG. 10. Shown are a hook-and-loop style attachments, which in the industry are also known as Velcro®. In a preferred embodiment, the part of the hook-and-loop attachment system that is attached to the wader 100 would be larger in diameter or size. This would allow for dimensional misalignments as material stretches or wrinkles.

Figure 13:
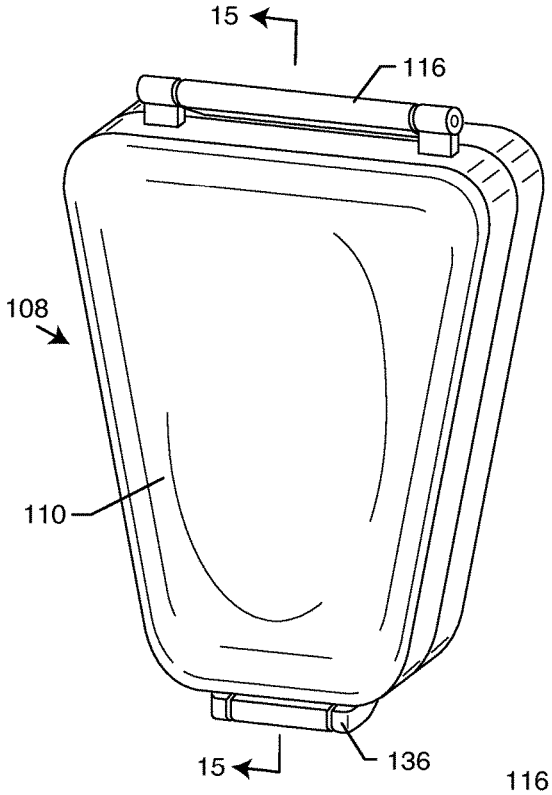
FIG. 13 is a perspective view of another exemplary relief hatch embodying the present invention.
Figure 14:
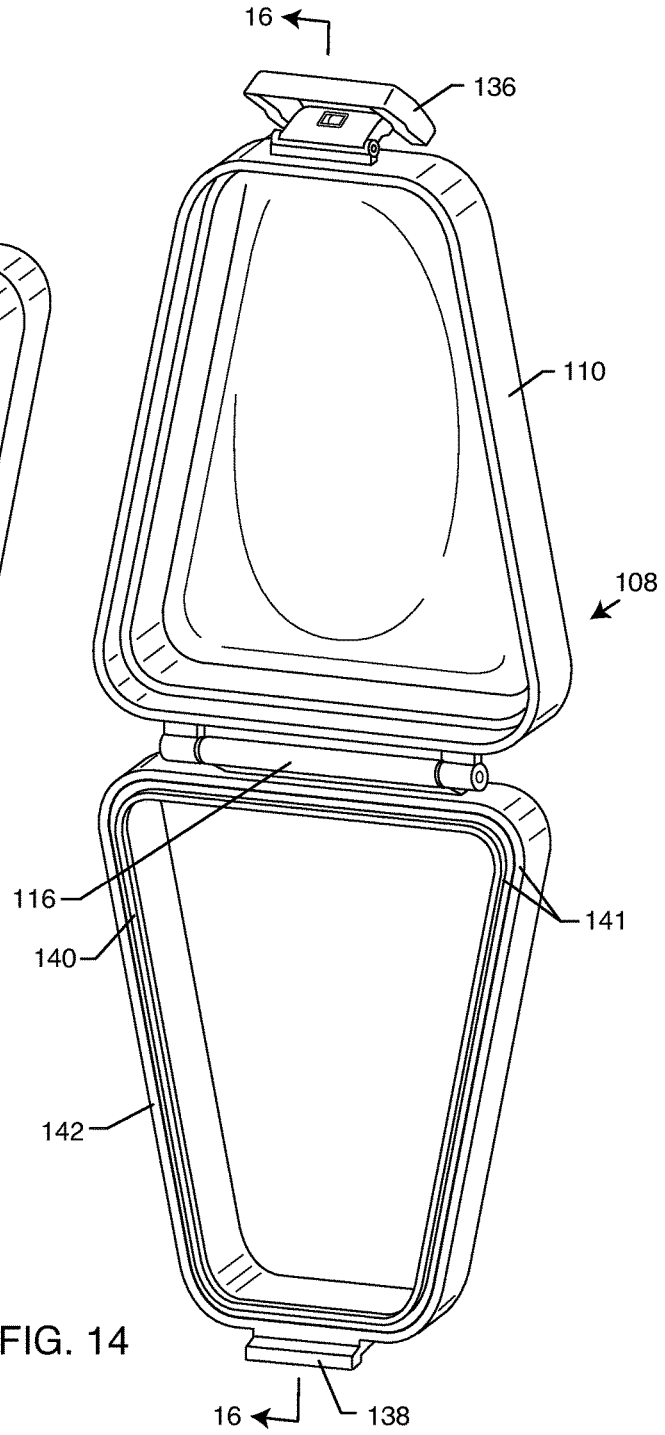
FIG. 14 is a view similar to FIG. 13 now showing the relief hatch in the open position.

FIG. 13 is very similar to FIG. 3 except that the urinary relief hatch assembly 108 has more of a triangular shape and also has a different type of container and catch mechanism. For strength, in a preferred embodiment, the hinge 116 is shown full width. A compression latch 136 is used to compress the lid 110 against an O-ring seal 140. The O-ring seal 140 is fitted into a groove 141, which is better shown in FIG. 14. FIG. 14 shows the urinary relief hatch 108 of FIG. 13 in the open position. One can see the compression latch 136 and the compression latch retainer 138. The compression latch, when pushed down, compresses the edge of the lid 110 firmly against the O-ring 140 which ratchet seals it and makes it water tight. It will be obvious to those skilled in the art that any number of alternative dimensions could be used to provide convenient access for urination. It will also be obvious to those skilled in the art that any of the retention devices as previously illustrated in FIGS. 10, 11 and 12 may be adapted to the mechanism as illustrated in FIGS. 13 and 14.

Figure 15:
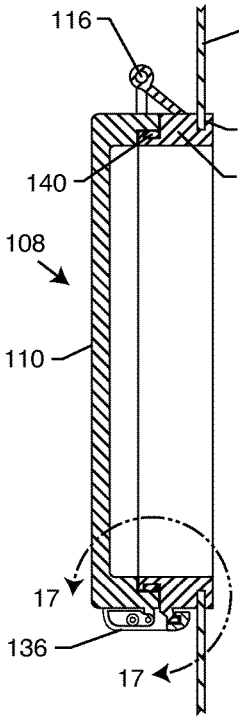
FIG. 15 is a cross-sectional view of the structure of FIG. 13 taken along line 15-15.
Figure 16:
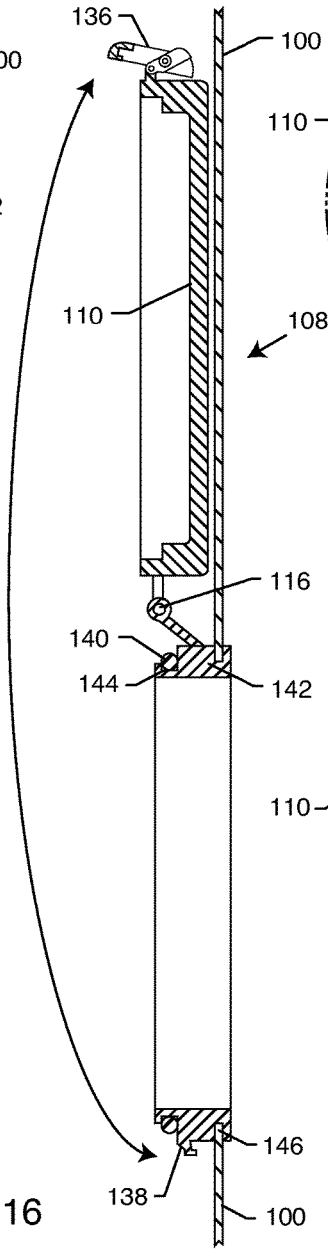
FIG. 16 is a cross-sectional view of the structure of FIG. 14 taken along line 16-16.

FIG. 15 is a sectional view taken from section 15-15 from FIG. 13. It shows the lid 110 in the closed position with the compression latch 136 firmly seated in place, which is compressing O-ring 140 in both the axial and side load directions. This forms a very tight water-tight seal. Item 142 is a very rigid seating assembly for the O-ring, which also holds it firmly in place. It is really hard to visualize how the O-ring 140 is seated while it is compressed like this. One is referred to FIG. 16, which is taken from section 16-16 from FIG. 14. This shows the urinary relief lid 110 in the open position. With this in the open position, one can now clearly see the O-ring 140 in its uncompressed state. One can also see that there is a little groove or slot 144 into which the O-ring is firmly seated. To replace the O-ring, one expands the O-ring by stretching it in diameter and then slips it into this slot where it snaps firmly into place where it cannot come out. An alternative (not shown) would be to add some silicone grease all along the O-ring, which helps it to form a water-tight seal.

Figure 17:
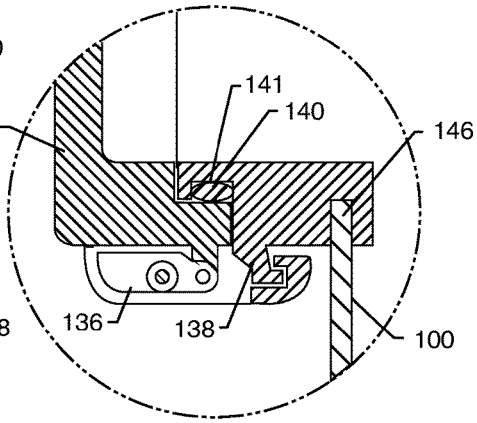
FIG. 17 is a close-up view of the structure of FIG. 15 taken along line 17-17.

FIG. 17 is taken from section 17-17 from FIG. 15 and shows an enlarged view of the compression latch 136 firmly seated against its retainer 138. This firmly compresses the O-ring 140 as shown, forming a water-tight seal.

Figure 18:
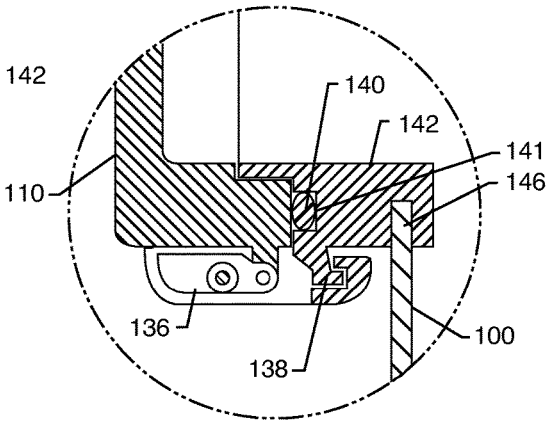
FIG. 18 is a view similar to FIG. 17 now showing an alternative sealing arrangement.

FIG. 18 is very similar to FIG. 17 except in this case, the O-ring is in straight compression when the lid 110 is seated. That is, the edge of lid 110 presses straight down against the O-ring, which causes it to change shape from a circle to more of an oval. Again, this forms a solid water-tight seal. Referring back to FIGS. 15, 16, 17 and 18, one can also see that there is a joint 146 between the wader or rain gear material and a groove that is formed in the urinary retention device 108. The material 100 is held firmly in this groove 146 by compression, by glues or cements, by thermal-setting adhesives or the like.

Figure 19:
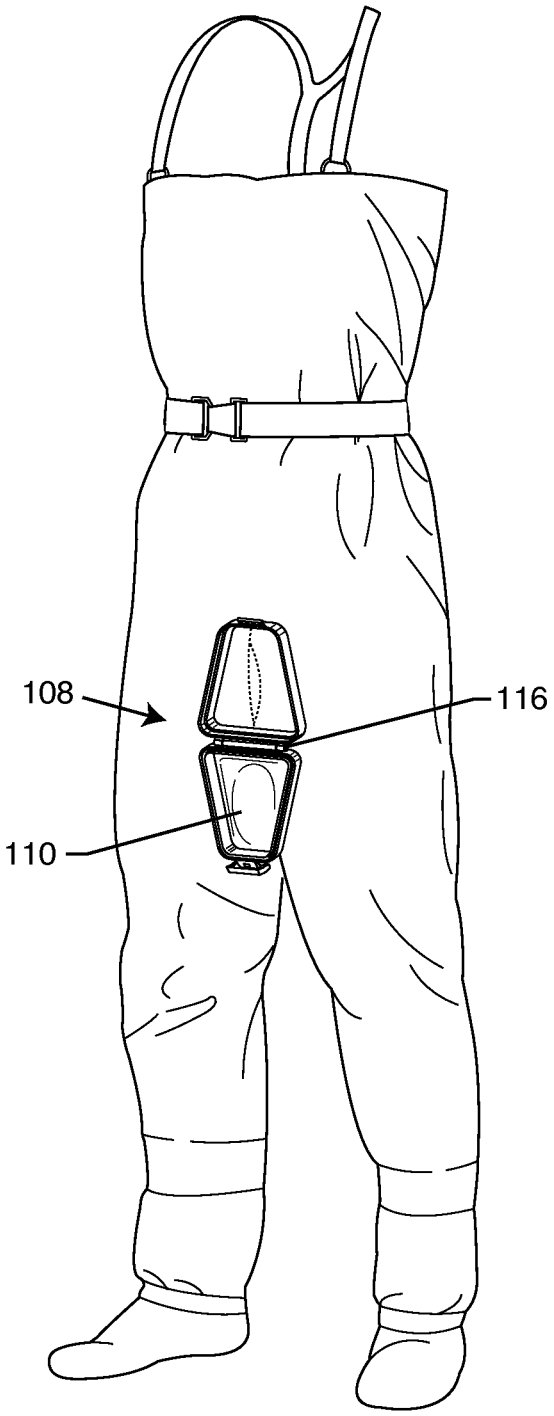
FIG. 19 is a perspective view of yet another embodiment of an exemplary relief hatch now showing the lid opening downwards.

FIG. 19 is very similar to FIGS. 2, 13 and 14 except that in this case, the hinge 116 has been inverted so that it appears towards the bottom. In this case, there is no need for any type of retention device as previously illustrated in FIGS. 10, 11 and 12. In this case, the lid 110 flaps down and is held simply in place by gravity while one goes about the process of urination. One advantage of this assembly as illustrated in FIG. 19 is its simplicity and reduced costs. Cost is reduced by not needing to provide for a retention device to hold the lid in the upward position. There are also some geometry advantages to the structure as illustrated in FIG. 19 as this provides a more open access through the undergarment.

Figure 20:
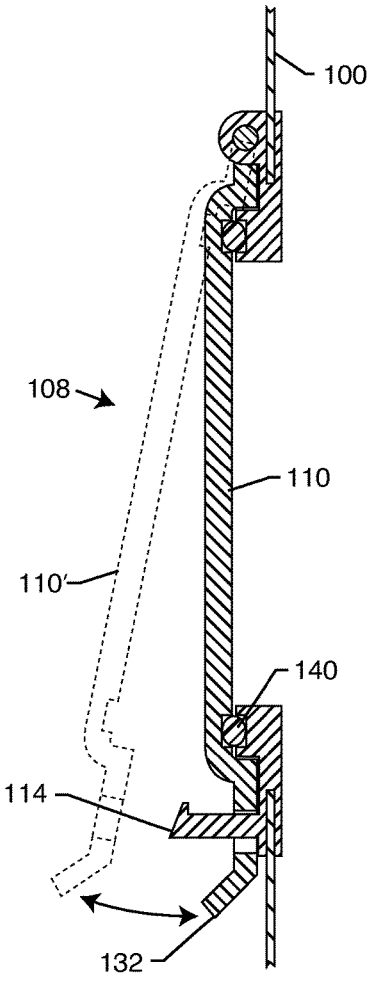
FIG. 20 is a cross-sectional view of another exemplary relief hatch embodying the present invention.
Figure 21:
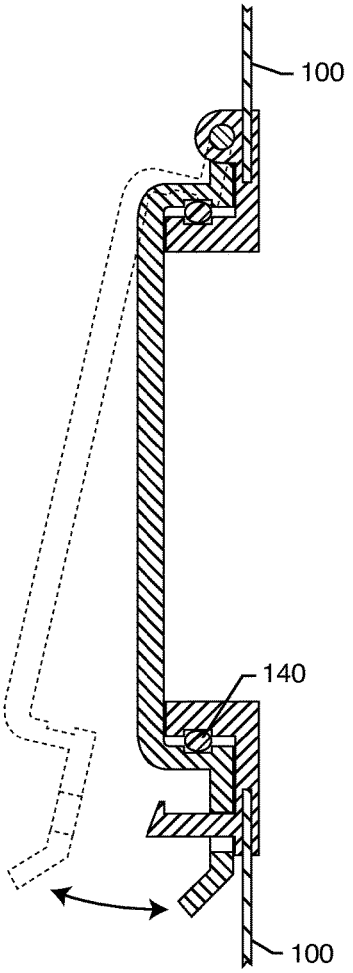
FIG. 21 is a cross-sectional view of another exemplary relief hatch embodying the present invention.

FIG. 20 illustrates a different type of O-ring compression assembly and is similar to those previously described in FIGS. 15 through 18. In the case of FIG. 20, one simply pushes downward on latch mechanism 114 while at the same time, pulls up on the handle mechanism 132. This allows one to swing the lid 110 into its opening position 110'. As can be seen, in this configuration, the O-ring 140 is in direct compression. An alternative to FIG. 20 is shown in FIG. 21 and is very similar except that the O-ring is in both side and axial compression.

Figure 22:
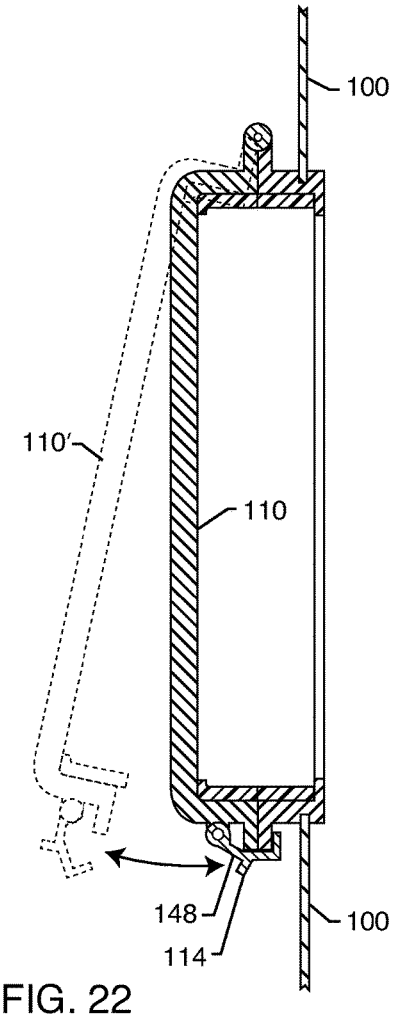
FIG. 22 is a cross-sectional view of another exemplary relief hatch embodying the present invention.

FIG. 22 is yet another type of latch retainer mechanism 148 which pivots on a hinge. One can see that by applying their thumb to location 114, it is easy to rotate this latch so that the lid 110 can be swung into its open position 110'.

Figure 23:
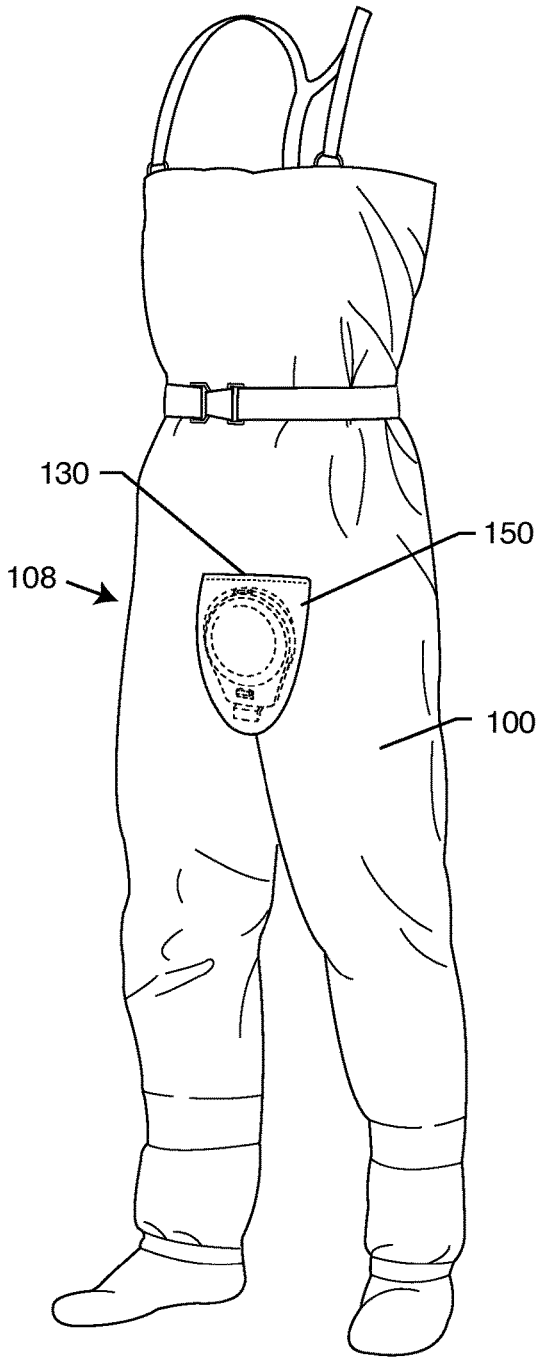
FIG. 23 is a perspective view of an aesthetic cover for any of the exemplary embodiments of the relief hatch.

FIG. 23 is an alternative view of the wader relief mechanism 108 as previously illustrated in FIGS. 2, 19 and any alternative thereof. In this case there is a flap 150 which covers over the urinary relief mechanism 108, but preserves a better cosmetic look for the garment. The flap 150 may be of the same material as the wader itself. It may be held down by hook-and-loop type closures.

Figure 24:
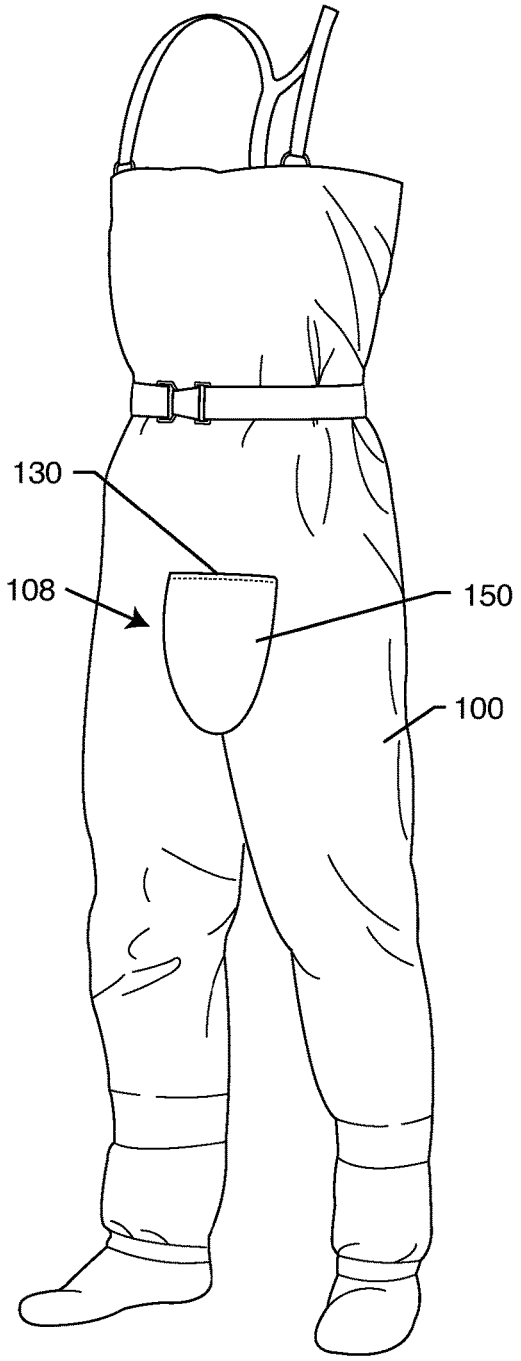
FIG. 24 is similar to FIG. 23 now showing the relief hatch hidden.

FIG. 24 is the same as FIG. 23 which illustrates the flap 150 without the dash lines showing the present invention 108 underneath. One can see by looking at FIG. 24 that this does provide a better cosmetic appearance.

There are several possibilities for the marketing of the urinary relief hatch assembly 108 of the present invention. One would be during original manufacturing of the wader and the rain garment, to simply install the urinary relief hatch at that time. Compatible materials would be used so that automated thermal-bonding or glue/adhesive processes can be used to join the wader material 100 to a flange 130, which is part of the urinary relief mechanism 108. However, there is a very important aftermarket. Many people already own very expensive waders and would like to retrofit their waders to add the urinary relief mechanism 108.

Figure 25:
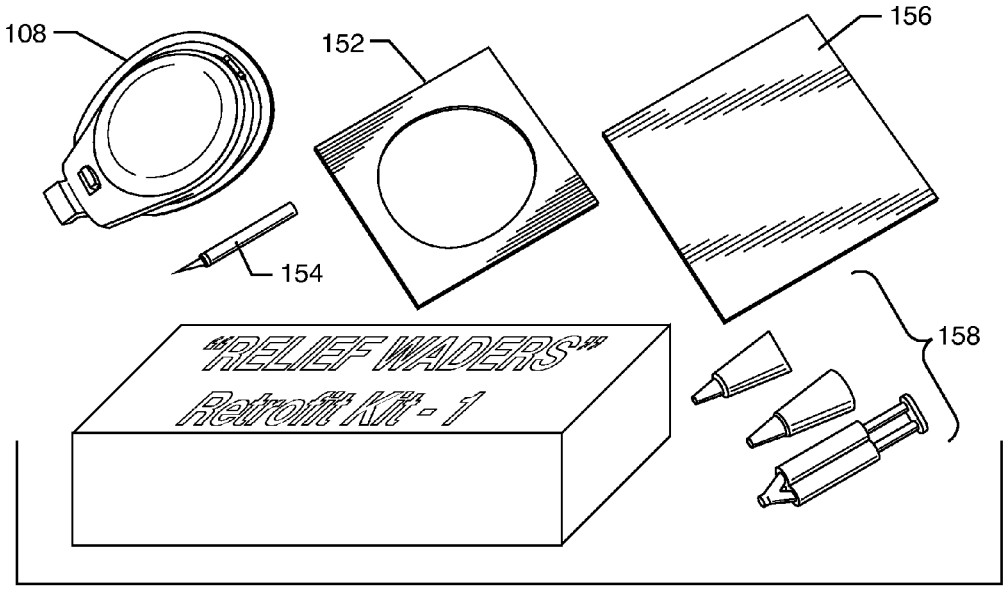
FIG. 25 is a perspective view of an exemplary embodiment of a relief hatch retro-fit kit.

FIG. 25 illustrates a kit which may be sold as an aftermarket assembly. The kit would contain the urinary relief hatch 108 of the present invention along with a template 152 which would come with instructions and in a preferred embodiment, a sticky adhesive 158 so that this could be placed on the garment. One could then either use the template 152 to trace a line with permanent ink, or use it as a cutting template to take a sharp knife 154 or scissors and cut an appropriate opening in the wader garment 100. A convenient cutting board 156 may be optionally supplied which can be placed inside and behind where the cutting is to take place. This backing board 156 is very important because it would destroy the waders to cut through both the front and back sides at the same time.

Figure 26:
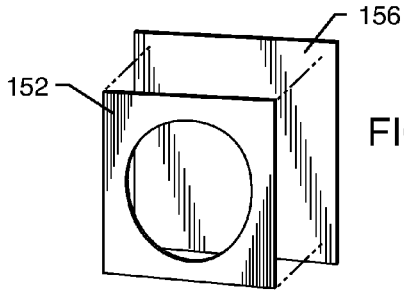
FIG. 26 is a perspective view of a cut-out template and a cutting board.

FIG. 26 illustrates placing the backing or cutting board 156 inside the wader in the appropriate location and roughly centered over template 152. Also shown, are a number of glues, adhesives or even epoxies 158 which may be used. There would be a variety of bonding agents 158 supplied in the kit along with instructions so that the user can properly identify which type of wader they have and what type of material it has and therefore what kind of sealant it will be compatible with.

Figure 27:
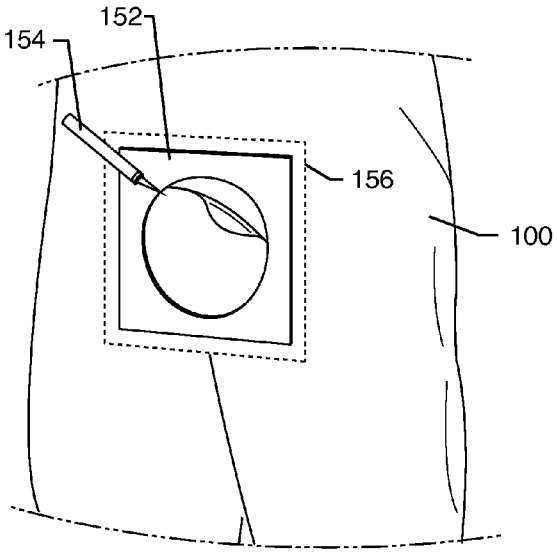
FIG. 27 is a perspective view of the cut-out template of FIG. 26 being cut along a wader with the cutting board behind.

FIG. 27 illustrates the use of the template 152 and the cutting tool 154 to make the primary opening in the front of the waders 100.

Figure 28:
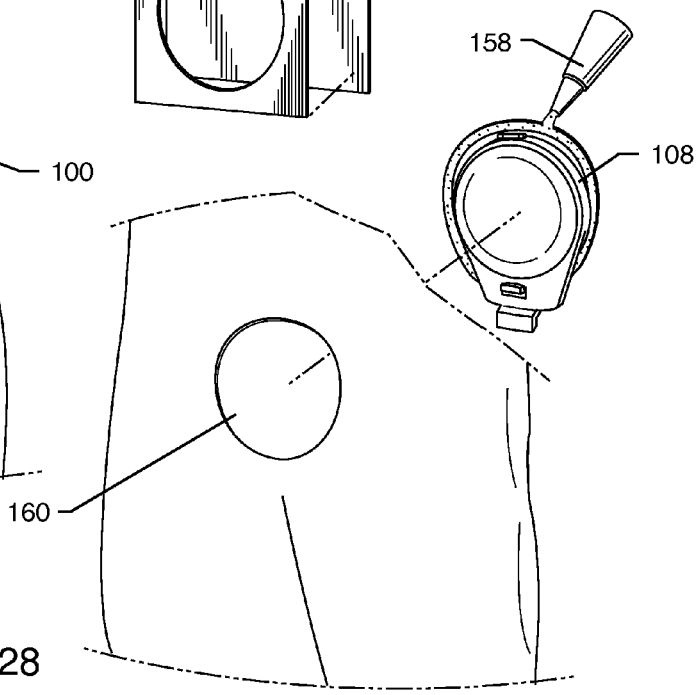
FIG. 28 is a perspective view showing an exemplary embodiment of bonding the relief hatch of FIG. 25. to the wader.

FIG. 28 shows the opening 160 into which the urinary relief assembly 108 is fitted into place. As one can see, the appropriate adhesive material 158 is first applied and then the urinary relief hatch is placed into the hole 160. This can be done through the inside as shown or from the outside (not shown).

Figure 29:
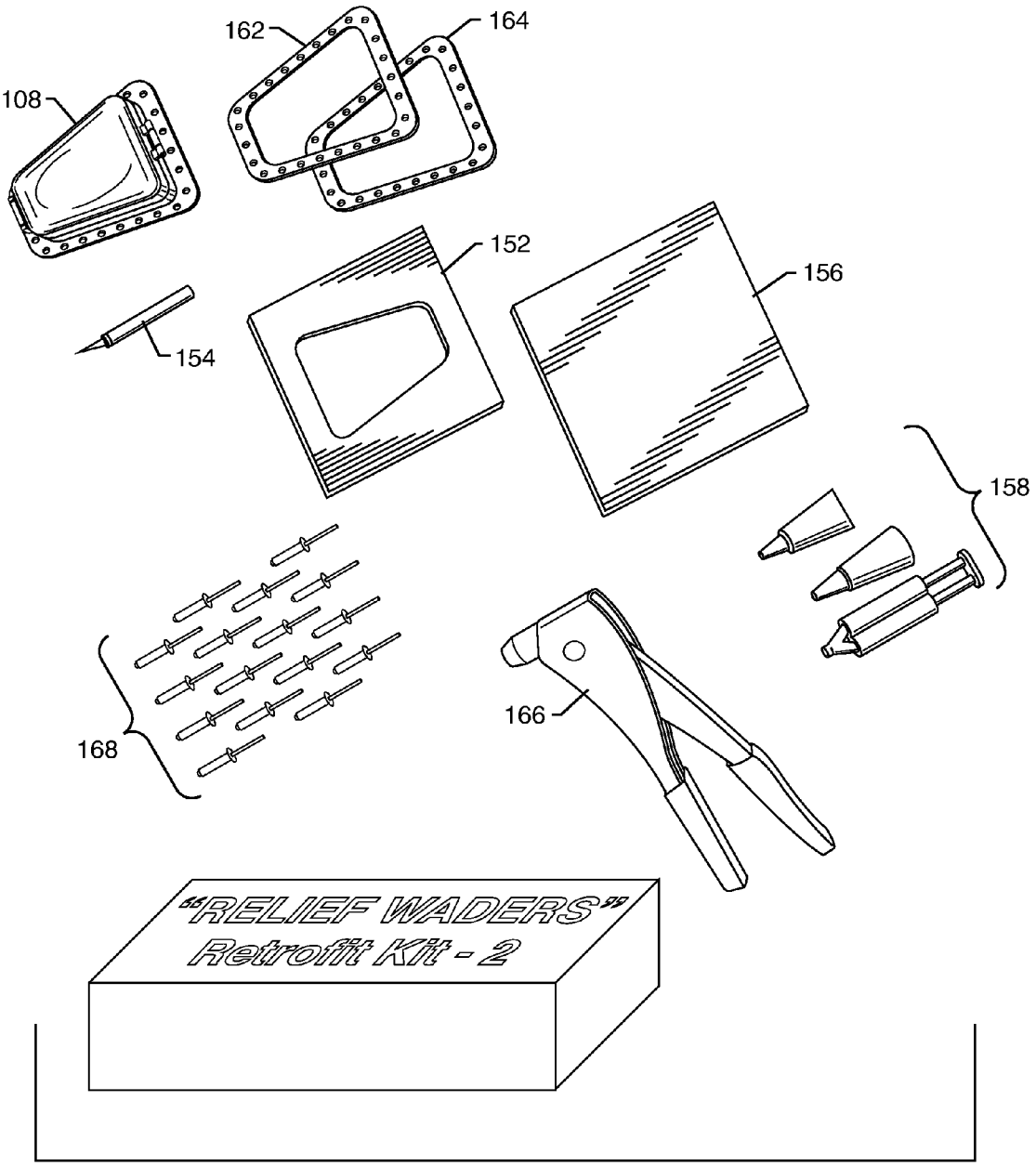
FIG. 29 is a perspective view of another exemplary embodiment of a relief hatch retro-fit kit.

FIG. 29 is a kit very similar to FIG. 25 and is used in very much the same way. Provided are two compressible rubber or neoprene or the like gaskets 162 and 164. There is also a cutting template 152 and a backing board 156 along with the appropriate adhesives 158 as previously described in FIG. 25. In lieu of the adhesives, a pop rivet tool 166 may be provided along with the appropriate number of pop rivets 168 so that one can literally sandwich the wader material 100 (not shown) between the two gaskets 162 and 164 and then pop rivet everything in place. Pop rivets can press together solidly as they are tightened by compressing the two gaskets 162 and 164, which are flexible. This provides a water-tight seal all around the periphery of the urinary retention device 108. It will be obvious to one skilled in the art that any other type of fastener, such as screws and small bolt heads and the like may be used.

Figure 30:
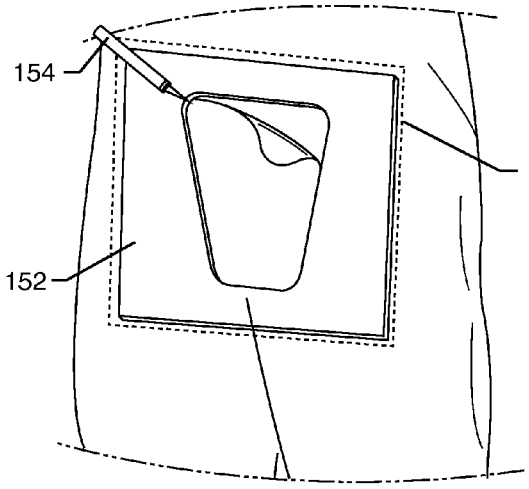
FIG. 30 is a perspective view of the cut-out template of FIG. 29 being cut along a wader with the cutting board behind.

FIG. 30 is an enlarged view showing the use of the template 152 and backing plate 156 previously described in FIG. 29.

Figure 31:
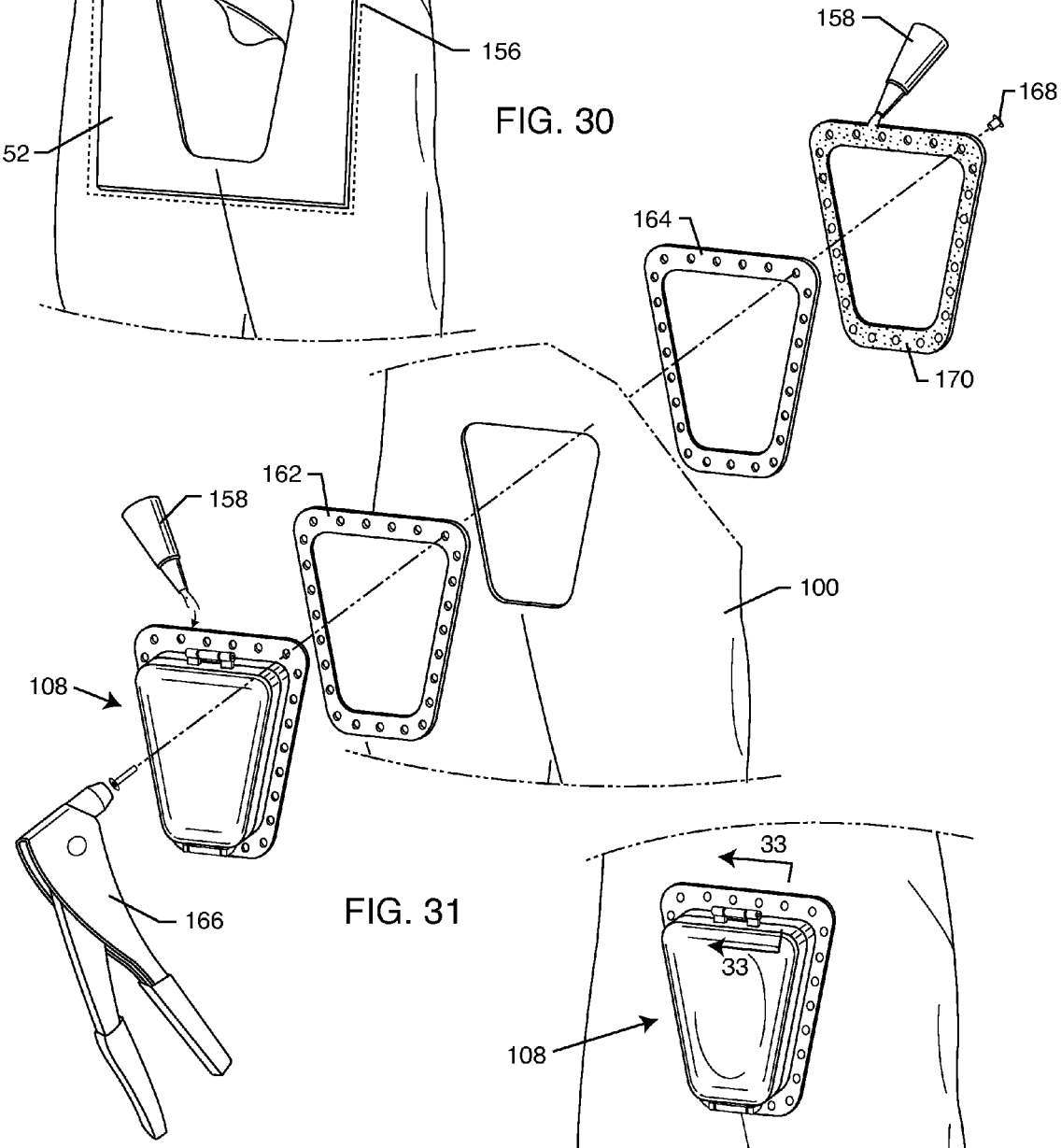
FIG. 31 is an exploded perspective view of the structure of FIG. 29 being fixtured and sealed to the wader.
Figure 32:
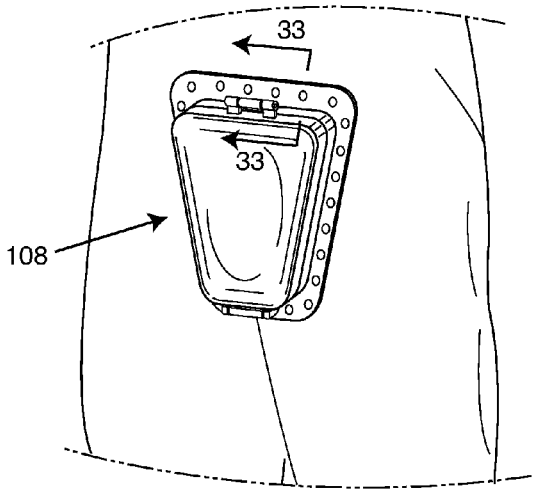
FIG. 32 is a perspective view of the finished assembly of FIG. 31.

As shown in FIG. 31, the various components of the assembly are lined up. An adhesive, sealant or glue 158 is optionally applied prior to the seating of the components. The pop rivet gun 166 is used to place pop rivets 168 through each of the holes. The completed assembly, as shown in FIG. 32, forms a water-tight urinary relief hatch of the present invention. A backing plate 170 is provided for which to place the pop rivets. It is important that the backing plate 170 be of a rigid material and that the pop rivet holes or screw holes be placed close enough apart so that the gaskets 162 and 164 are uniformly compressed in a way that water cannot ingress.

Figure 33:
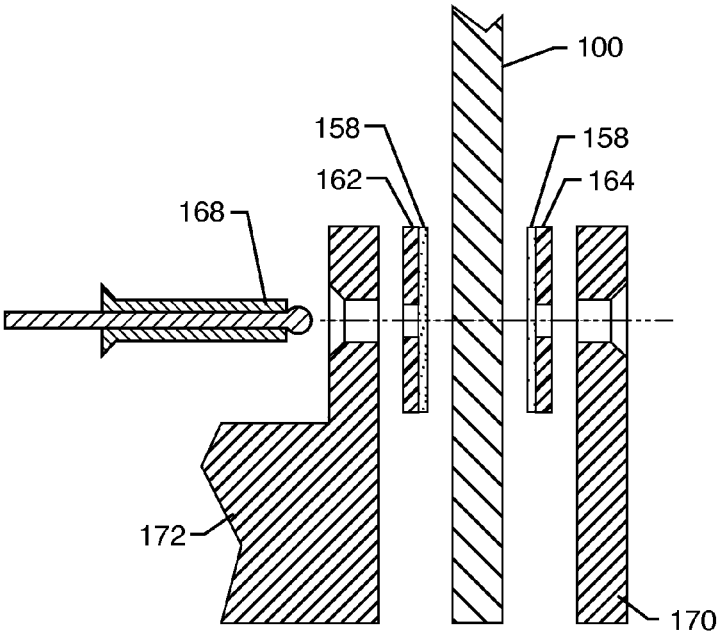
FIG. 33 is a cross-sectional view of the structure of FIG. 32 taken along line 33-33 just before completion of fastening.

FIG. 33 is a sectional view taken from section 33-33 from FIG. 32. Shown is the pop rivet 168 along with the cross-sectional view of the flange of the urinary retention device of wader material 100 along with the two gaskets 162 and 164. In a preferred embodiment, only one gasket 162 or 164 is needed to form a reliable seal. FIG. 33 shows the male end of the rivet **168*a* being inserted through the flange of the urinary retention block 172, through sealing gasket 162, through a pre-punched hole in the wader material 100 and through the secondary gasket 164 lined up with the holes in the retention flange 170**.

Figure 34:
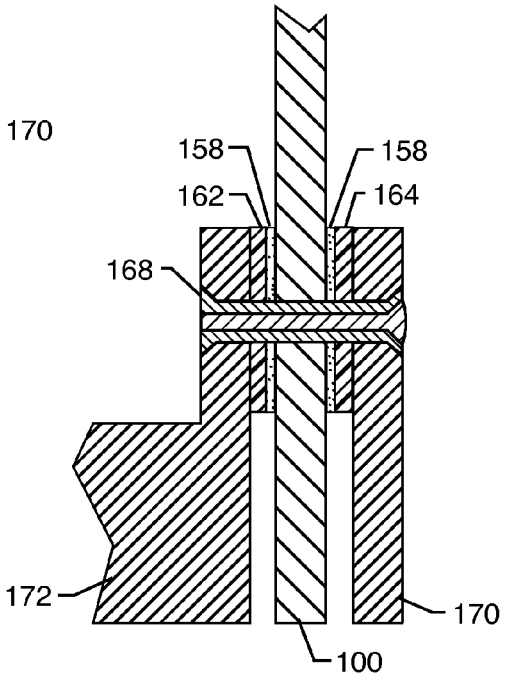
FIG. 34 is a cross-sectional view similar to FIG. 33 now showing the finished assembly being watertight.

FIG. 34 is very similar to FIG. 33 showing the rivet in its compressed state. As can be seen, gaskets 162 and 164 have been firmly compressed against the wader material or rain gear material 100. In an optional embodiment, an adhesive 158 may be placed over both ends of each of the pop rivets to make sure that they do not leak water.

Figure 35:
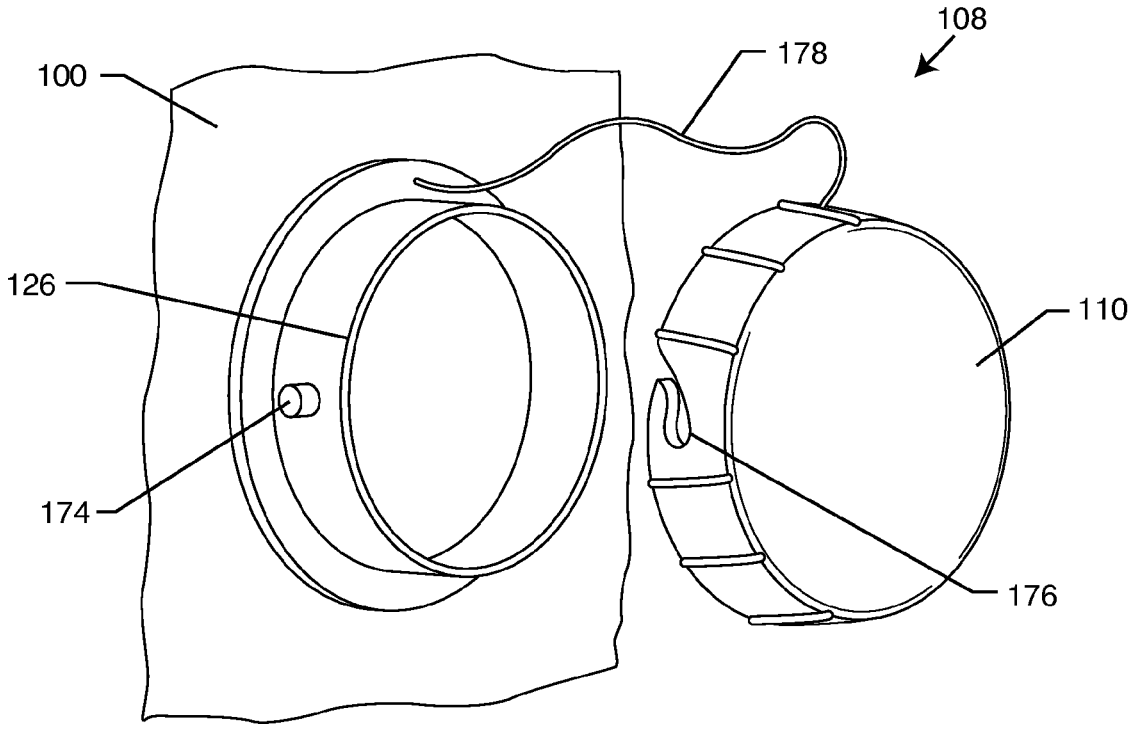
FIG. 35 is a perspective view of another exemplary embodiment of a relief hatch.

FIG. 35 is an alternative form of the invention with a twist cap lid 110 with taper engagement slots 176 which are designed to engage pins 174. As the cap is twisted, it is compressed against gasket seat 126. There is a gasket on the inside of the twist housing 110 (not shown). As the twist cap 110 is tightened, the gasket (not shown) is compressed against the gasket seat 126 in order to affect a water-tight seal. There is an optional tether 178 which can be of any suitable material which prevents the cap 110 from getting lost. Additionally, the tether 178 may be attached to the side of the wader such that when the lid 110 is opened, the lid 110 will be out of the way during urination. Alternatively, the tether 178 may be made of an elastic material such that the lid 110 is retracted further away from the aperture when opened. Referring once again to FIG. 35, one can see that this design offers a number of advantages, in that it is very quick and easy to use. Only a slight rotation of the cap lid 110 is required to engage the pins 174 and properly seat the gasket structure.

Figure 36:
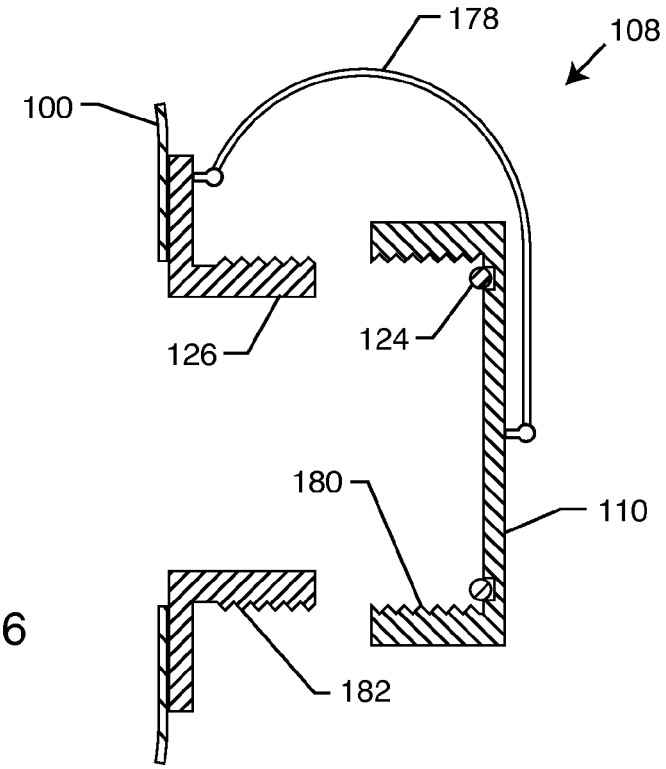
FIG. 36 is a sectional view of another exemplary embodiment of a relief hatch.

FIG. 36 is another type of round cap 110, but in this case, it has female threads 180 which are designed to engage male threads 182 of the O-ring seat 126. When the cap 110 is threaded down tightly, O-ring 124 is compressed against the O-ring seat 126 which affects a water-tight seal. Again, there is an optional tether 178 shown for the same purposes as previously described in FIG. 35. The tether 178 is rotatively attached to the center of the cap 110 so that it does not get tangled up as the cap 110 is screwed in place.

Although several embodiments have been described in detail for purposes of illustration, various modifications may be made to each without departing from the scope and spirit of the invention. Accordingly, the invention is not to be limited, except as by the appended claims.

What is claimed is:

1. A relief hatch retro-fit kit for a pair of waders or pants, the kit comprising:

a substantially rigid base sealable to the pair of waders or pants and disposable in a groin section of the pair of waders or pants, wherein the base forms an aperture;

a substantially rigid lid pivotably connectable to the base and configured to engage the aperture forming a waterproof closure between the base and the lid when the lid is in a closed position;

a cutting template for marking on the pair of waders or pants a cut path; and a deformable seal disposed between the base and the lid preventing water from passing through the aperture when the lid is in the closed position;

wherein the deformable seal is a different material from either the base or the lid; and wherein the deformable seal is an O-ring seal, a silicone rubber seal or a flexible material seal.

2. The kit of claim 1, wherein the base comprises a flange for sealing to the pair of waders or pants.

3. The kit of claim 2, including an adhesive for creating a waterproof bond between the flange and the pair of waders or pants.

4. The kit of claim 2, including a backing plate configured to fasten to the flange securing the pair of pants therebetween and forming a waterproof seal between the base and the pair of waders or pants.

5. The kit of claim 4, including a plurality of fasteners for fastening the backing plate to the flange with the pair of waders or pants therebetween.

6. The kit of claim 4, including a plurality of rivets and a rivet gun for fastening the backing plate to the flange with the pair of waders or pants therebetween.

7. The kit of claim 4, including at least one seal configured for placement between the flange and the backing plate.

8. The kit of claim 1, including a cutting board for placement inside the pair of pants when cutting along the cut path.

9. The kit of claim 1, including a manually releasable latch connected to the base and configured to retain the lid in the closed position or including a compression latch connected to either the lid or base and configured to secure together the lid and base.

10. A relief hatch retro-fit kit configured to attach to a pair of pants, the pair of pants comprising a first and second foot or boot portion joined respectively to a first and second leg portion, wherein the first and second leg portions are joined to a torso portion terminating generally at or between a waist and a neck of a wearer and wherein the pair of pants comprise a substantially waterproof material, the kit comprising:

a substantially rigid base sealable to the pair of pants and disposable in a groin section of the pair of pants, wherein the base forms an aperture;

a substantially rigid lid connectable to the base and configured to engage the aperture;

a seal disposed between the base and the lid forming a waterproof closure between the base and the lid when the lid is in a closed position;

a cutting template for marking on the pair of pants a cut path; and an adhesive creating a permanent waterproof bond between the base and the pair of pants.

11. The kit of claim 10, wherein the base comprises a flange for sealing to the pair of pants, and wherein the adhesive for creating a waterproof bond is disposed between the flange and the pair of pants.

12. The kit of claim 11, including a backing plate configured to fasten to the flange for securing the pair of pants therebetween and facilitating the forming of the waterproof bond between the flange and the pair of pants.

13. The kit of claim 12, including a plurality of fasteners for fastening the backing plate to the flange with the pair of pants therebetween or including a plurality of rivets and a rivet gun for fastening the backing plate to the flange with the pair of pants therebetween.

14. The kit of claim 12, including a cutting board for placement inside the pair of pants when cutting along the cut path.

15. A relief hatch retro-fit kit configured to attach to a pair of pants, the pair of pants comprising a first and second foot or boot portion joined respectively to a first and second leg portion, wherein the first and second leg portions are joined to a torso portion terminating generally at or between a waist and a neck of a wearer and wherein the pair of pants comprise a substantially waterproof material, the kit comprising:

a substantially rigid base sealable to the pair of pants and disposable in a groin section of the pair of pants, wherein the base forms an aperture;

a substantially rigid lid pivotably connectable to the base and configured to engage the aperture;

a seal disposed between the base and the lid forming a waterproof closure between the base and the lid when the lid is in a closed position;

a manually releasable latch connected to the base and configured to retain the lid in the closed position or a compression latch connected to either the lid or base and configured to secure together the lid and base; and a second seal configured for placement between the base and the pair of pants, the second seal forming a waterproof seal between the pair of pants and the base.

16. The kit of claim 15, wherein the substantially rigid base comprises a flange for sealing to the pair of pants, and wherein the second seal for creating a waterproof seal is disposed between the flange and the pair of pants.

17. The kit of claim 16, including a backing plate configured to fasten to the flange securing the pair of pants therebetween.

18. The kit of claim 17, including a plurality of fasteners for fastening the backing plate to the flange with the pair of pants therebetween or including a plurality of rivets and a rivet gun for fastening the backing plate to the flange with the pair of pants therebetween.

19. The kit of claim 15, including a cutting template for marking on the pair of pants a cut path.

20. The kit of claim 19, including a cutting board for placement inside the pair of pants when cutting along the cut path.

* * * * *